United States Patent [19]

Agouri et al.

[11] 4,152,317

[45] May 1, 1979

[54] PROCESS FOR IMPROVING THE WATER WETTABILITY OF POLYOLEFINS

[75] Inventors: Elias Agouri; Jacques Rideau, both of Pau, France

[73] Assignee: Ato Chimie, Courbevoie, France

[21] Appl. No.: 864,791

[22] Filed: Dec. 28, 1977

[30] Foreign Application Priority Data

Dec. 30, 1976 [FR] France ..... 76 39548

[51] Int. Cl.[2] ..... C08L 29/04

[52] U.S. Cl. ..... 260/42.46; 260/29.6 XA; 260/29.6 WA; 260/42.55; 260/897 B; 162/146; 162/157 R; 162/182

[58] Field of Search ..... 260/897 B, 42.46, 42.55, 260/29.6 XA, 29.6 WA; 162/157 R, 146, 182; 264/140

[56] References Cited

U.S. PATENT DOCUMENTS

| | | | |
|---|---|---|---|
| 3,920,507 | 11/1975 | Yonemori | 162/157 R |
| 4,049,493 | 9/1977 | Lare | 162/157 R |
| 4,064,304 | 12/1977 | Fujita et al. | 162/157 R |

*Primary Examiner*—Carman J. Seccuro

*Attorney, Agent, or Firm*—Burgess, Ryan and Wayne

[57] ABSTRACT

The present invention relates to a process for improving the water wettability of polyolefins, especially under the form of fibers, fibrils or powders.

The thus treated polyolefins have an improved wettability, which in the treatment conducted in aqueous suspension facilitates their dispersion in water. This is among others the case in the production of at least partially synthetic papers.

26 Claims, No Drawings

PROCESS FOR IMPROVING THE WATER WETTABILITY OF POLYOLEFINS

The invention concerns a process for the treatment of polyolefins, and especially polyolefins in the form of fibers, fibrils or powders, with a view to improving their water wettability.

For certain applications, compositions containing polyolefins have to be prepared by methods which include the treatment in aqueous suspension of the said polyolefins. Thus in the production of partially synthetic papers, polyolefins in the form of fibrils are incorporated into a cellulose paste by classical paper techniques which requires, as is known, mixing and treatment in aqueous suspension of the various ingredients which are to be included in the paper paste.

Since polyolefins are purely hydrocarbon in nature, thus hydrophobic, they are difficult to put into aqueous suspension, and it is usually necessary to modify them in order to give them a certain wettability with a view to improving their dispersion in water, before using them in the applications which necessitate treatments in aqueous suspension.

One of the methods used to improve the wettability of polyolefins consists in treating the said polyolefins with a polyvinyl alcohol in aqueous suspension. An aqueous dispersion of polyolefin fibers is produced by a mixture of polyolefin fibers with a liquid hydrocarbon, for example hexane or cyclohexane, by putting the said mixture into contact with water in the presence of polyvinyl alcohol and by heating the suspension thus formed in order to vaporize and eliminate the liquid hydrocarbon from the fibers.

Although the polyolefin fibers treated by this method have statistically a greater wettability than non-treated fibers, the distribution of the polyvinyl alcohol on the fibers in not very homogeneous, and one can observe in the obtained aqueous suspension, the presence in a more or less large proportion of fibers which, due to an insufficient wettability, are poorly dispersed or are collected into bundles.

A variation of this treatment in which a polyvinyl alcohol associated with a surface-active agent is used gives only a slight improvement of the fibers water wettability in comparison with a treatment using only polyvinyl alcohol.

It was suggested to improve the effectiveness of the polyvinyl alcohol treatment of the fibers by replacing the polyvinyl alcohol by the reaction product of such an alcohol with an aliphatic aldehyde having 1 to 6 carbon atoms, for example propionic aldehyde or butyric aldehyde. However, the use of a polyvinyl alcohol thus modified by an aldehyde renders the implementing of the process more complex, and thus more costly, which is a disadvantage which cannot be ignored in industry.

It has now been discovered that the water wettability of polyolefins, can be greatly inproved, in the form of fibers, fibrils, or powders, by treatment with an aqueous solution of a polyvinyl alcohol, if this treatment takes place in the presence of an alkali metal hydroxide used in a quantity at least equal to 0.5 times that of the polyvinyl alcohol. Such a treatment is economical since its implementation is simple, it does not require costly products and moreover, it produces polyolefins, especially fibers, fibrils and powders, which have an excellent water wettability and are very homogeneously dispersable in aqueous media.

In the preparation of fibrils by the flash spinning method in which a polyolefin solution in a hydrocarbon solvent is fed, under high pressure (in the order of 20 to 100 bars), into a die, then expanded at atmospheric pressure through an appropriate orifice, it is also known to add to the polyolefin solution in the hydrocarbon solution, a minor quantity of polyvinyl alcohol in solution in an appropriate solvent and a quantity of sodium hydroxide less than 1% of the weight of the polyvinyl alcohol used. However, the fibrils which are collected after the passing of the polyolefin solution through the orifice are very irregular and are only slightly water wettable. Due to this fact, it was totally unexpected to be able to improve the water wettability of polyolefins and more especially in the form of fibers, fibrils or powders, by treating the said fibrils according to the conditions of the invention process.

The said process according to the invention for improving the water wettability of polyolefins, especially in the form of fibers, fibrils or powders, in which the said polyolefins are contacted with a polyvinyl alcohol in an aqueous medium, is characterized in that the said contact takes place in the presence of an alkali metal hydroxide, in weight at least equal to half the quantity of polyvinyl alcohol used.

The polyolefins, their water wettability being improvable according to the process of the invention, are more especially copolymers or homopolymers of $C_2$ to $C_8$ olefins, and preferably of $C_2$ to $C_6$ olefins, as well as copolymers of such olefins with minor quantities, for example 0.5 to 30 moles %, of vinylic monomers such as, especially, vinyl acetate, styrene, alkyl methacrylates or acrylates (especially methyl or ethyl methacrylate or acrylate), maleic anhydride. Without limitation, one may cite polymers such as polyethylene, polypropylene, polybutenes, polypentenes, propylene/ethylene copolymers, butene/ethylene copolymers, poly(4-methyl pentene-1), vinyl acetate/ethylene copolymers, maleic anhydride/ethylene copolymers, and ethylene/ethyl or methyl methacrylate or acrylate copolymers. These polyolefins are preferably in the form of fibers, fibrils or powders when they are submitted to the polyvinyl alcohol treatment in the presence of an alkali metal hydroxide. The treatment is more particularly applicable to improve the water wettability of the polyolefin fibrils obtained by any of the fibrillation techniques, for example flash spinning, spinning extrusion, film fibrillation. The said treatment may also be used to advantage to improve the water wettability of the polyolefin powders prepared by various known techniques.

The alkali metal hydroxide, which is associated with the polyvinyl alcohol, is a hydroxide from a metal belonging to the Group IA of the Periodic Classification, such as published in the Chemical Engineers Handbook of Perry, fourth edition, the said hydroxide being more particularly sodium hydroxide or potassium hydroxide.

The quantity in weight of the alkali metal hydroxide is at least equal to half the quantity in weight of the polyvinyl alcohol used, and for reasons of economy it is not more than 10 times that of the said quantity of polyvinyl alcohol. It is preferable to use a quantity in weight of alkali metal hydroxide comprised between 0.8 and 5 times the quantity in weight of polyvinyl alcohol.

The polyvinyl alcohol used in the process according to the invention may be among any of the polyvinyl alcohols which exist on the market, the said polyvinyl alcohol usually being prepared by vinyl polyacetate hydrolysis and being commercially available at various degrees of hydrolysis. The most suitable polyvinyl alcohols to use are those which have a viscosity, measured at 20° C. in 4% aqueous solution, between 1 and 70 centipoises.

In order to indicate but not to limit one may cite as polyvinyl alcohols, suitable for the process according to the invention, those which are commercially indexed on page 216 of report No. 57 A, P.E.P. Stanford Research Institute, having viscosities between 3 and 65 (measured in a 4% aqueous solution at 20° C.), hydrolysis rates between 79 and 99.8% (molar percentage), and polymerization index (number of units derived from the monomer) between 350 and 2500.

The most suitable quantity of polyvinyl alcohol to put into contact with the polyolefin is between 0.1 and 10% and preferably between 0.3 and 3%, by weight of the treated polyolefin.

In implementing the process according to the invention the temperature is maintained between 5° C. and 90° C.; the said temperature is preferably between 10° C. and 50° C.

In the aqueous medium containing the polyolefin to be treated, the polyvinyl alcohol and the alkali metal hydroxide, the weight of polyolefin is best between 0.5 and 50%, and preferably between 1 and 20% by weight of water.

The contacting of the polyolefin, especially in the form of fibers, fibrils or powders, with the polyvinyl alcohol in aqueous solution and the alkali metal hydroxide may take place batchwise or in continuous operation. When carrying out an operation batchwise, one can, for example, introduce into a reactor in no matter what order water, the polyolefin to be treated, the polyvinyl alcohol and the alkali metal hydroxide, and maintain this mixture under agitation, at a chosen temperature, for example at room temperature, and for a time sufficient to obtain the desired result. The polyvinyl alcohol and the alkali metal hydroxide may be introduced into the reactor in solid form or in different aqueous solutions or in one and the same aqueous solution. When carrying out the process in a continuous operation, one can continually introduce at the entrance to a treatment zone, maintained at the desired temperature and under agitation or turbulence, respectively, the polyolefin to be treated the water, and, together or separately, the polyvinyl alcohol and the alkali metal hydroxide in solid form or in aqueous solution, and continually extract, at the exit of the said zone, the aqueous phase containing the said treated polyolefin, the length of time which the various ingredients remain in the treated zone being such that upon leaving this zone, the desired improved wettability of the treated polyolefins is obtained. At the end of the treatment, batchwise or in continuous operation, the polyolefin is separated from the aqueous phase by filtration, washed in water and dried. The recovered mother liquors may be reused to advantage after a possible readjustment to the appropriate values of the quantities of polyvinyl alcohol and alkali metal hydroxide which they contain.

As previously indicated, the improved water wettable polyolefins obtained by the process according to the invention are of particular interest in the applications which necessitate polyolefins which are submitted to treatments in aqueous suspension.

Thus in the manufacturing processes of sheets or films, partially or totally synthetic, especially used as substitutes for paper or material, in which a mat of fibers or fibrils is formed from the aqueous fibers or fibrils suspension, the said mat is then dried in order to form the film or sheet, a part or all of these fibers or fibrils may consist in improved water wettable fibers or fibrils, products which result from the treatment according to the invention.

The invention is illustrated by the following examples but is not limited to them.

EXAMPLE 1

A series of tests, to improve the water wettability, were carried out on polyolefin fibrils which were obtained by flash spinning of a hexane solution of polyethylene and have an average length of about 1 millimeter.

This series of tests comprises a test A conducted according to the invention and four tests B, C, D and E carried out according to the prior art.

TEST A

In a reactor, under agitation, with a capacity of 500ml, one introduces 100ml of water, 50mg of polyvinyl alcohol having a molar hydrolysis rate of 90% and a viscosity of between 5 and 6 centipoises. The contents of the reactor was heated to 50° C. until a homogenous phase was obtained, then 120mg of sodium hydroxide was added to the said phase. Then 300ml of water was added and an aqueous solution, the temperature of which fell to about 25° C., was obtained.

This temperature being maintained, 5g of polyethylene fibrils was dispersed into the said solution by agitation, and kept in contact with it for about 1 minute. The fibrils were then separated by filtration, then washed several times in water and wrung by passing them between two rubber cylinders.

TEST B

This test was carried out under conditions similar to those used in test A but without the use of sodium hydroxide.

TEST C

This test was carried out under conditions similar to those used in test A but the sodium hydroxide was replaced by 50mg of a surface-active agent, consisting in sodium dodecylbenzenesulphonates.

TEST D

A solution was prepared of 84g of polyethylene in 1000ml of pure hexane, then to this solution was added 10g of polyvinyl alcohol used in test A, 25mg of NaOH, 500ml of water, and 10g of sodium dodecylbenzenesulphonate. This mixture was then heated to 140° C., under pressure of 40 bars, then expanded at atmospheric pressure through an opening having a diameter of about 1mm. The product collected at the exit of the opening consisted in polyethylene fibrils having a relatively coarse fibril structure.

TEST E

This test was carried out under conditions similar to those chosen for test A using however a quantity of sodium hydroxide equal to 1% in weight of the quantity of polyvinyl alcohol.

On the fibrils collected at the end of each of the tests, one evaluates the wettability of the said fibrils on the one hand and on the other hand their ability to form sheets similar to paper sheets when mixed with cellulose fibers.

To evaluate the wettability, the critical surface tension of the fibrils at the end of each test must be determined, the critical surface tension of water (that is to say 73 dynes/cm) being used as a reference, the wettability of the said fibrils was medium to fairly good, good or very good, their critical surface tension being between 50 and 65 dynes/cm (fairly good wettability), between 65 and 73 dynes/cm (good wettability), and higher than 73 dynes/cm (very good wettability).

The critical surface tension of the modified polyolefins was determined by using the techniques defined herein-after, derives from the method proposed in the Standard ASTM-D 2578-67.

In this critical surface tension determination technique, the modified polyolefin (fibrils, powder, film) is placed on a blade carrier and drops of a liquid, with a known critical surface tension, are placed, on several parts of the said polyolefin to be treated, by means of a pipette or micro-syringe. Several solutions are used, each having a known critical surface tension and when the drop is dispersed on the modified polyolefin in 3 seconds, the same critical surface tension as that of the liquid used is attributed to the modified polyolefin. If the drop disperses in less than 3 seconds, the surface tension of the modified polyolefin is considered to be superior to that of the liquid.

To evaluate the ability, of the polyethylene fibrils of tests A to E, to form sheets, one prepares an aqueous dispersion of 75 parts cellulose fibers obtained from softwood and refined at about 30° SCHOPPER, and 25 parts of the said polyethylene fibrils; then a sheet of fibers is formed from this dispersion, and the said sheet is dried in order to obtain a sheet called "formed sheet". The aspect of the surface of the formed sheet thus obtained gives an indication of the degree of the dispersion of the polyethylene fibrils treated according to the invention in the mixture containing also the cellulose fibers, and consequently of their ability of association with cellulose fibers for the obtention of paper.

The result obtained by the various tests are contained in Table 1.

TABLE 1

| Test No | $\gamma c$ *) | The aspect of the formed sheets. |
|---|---|---|
| A | >73 | Very homogeneous dispersion of the fibrils No fluffiness of the formed sheet. |
| B | 52 | Considerable fluffiness. |
| C | 54 | Considerable fluffiness. Formation of foam when preparing the dispersion. |
| D | 51 | Considerable fluffiness. |
| E | 52 | Considerable fluffiness. |

*) $\gamma c$ = critical superficial tension in dynes/cm.

From the results set forth in the appended Table 1, it is evident that by treating the fibrils with polyvinyl alcohol under the conditions suggested by the prior art, that is to say with the help of polyvinyl alcohol alone (test B) or associated with a surface-active agent (test C) or by means of a polyvinyl alcohol in the presence of at least 1% in weight of sodium hydroxide (tests D and E), one only obtains wettabilities situated in the ranges medium to fairly good and moreover in the formed sheets prepared from modified fibrils, the dispersion of the polyethylene fibrils is not very homogeneous, the fibers of the polyethylene remaining at the surface and causing more or less fluffiness.

Under the conditions of the invention (test A), that is to say by treating the fibrils with a polyvinyl alcohol in the presence of an alkali metal hydroxide with a weight ratio of the said hydroxide to the polyvinyl alcohol being at least 0.5 (in the case of test A the said ratio was equal to 2.4) modified polyethylene fibrils are obtained having a very good wettability ($\gamma c > 73$ dynes/cm). Moreover, in the formed sheet prepared from the mixture of the polyethylene fibrils and cellulose fibers, the polyethylene fibrils are dispersed very homogeneously and no fluffiness is observed.

EXAMPLE 2

In a reactor, under agitation and having a capacity of 500ml, one introduces 100ml of water and 40mg of polyvinyl alcohol having a molar hydrolysis rate of 98% and a viscosity equal to 4 centipoises. The contents of the reactor was heated to 80° C. for a time sufficient to give rise to a homogenous phase, then 80mg of sodium hydroxide was added to the said phase. Then 300ml of water was added, the temperature of the solution thus formed stabilized itself at about 40° C.

This temperature being maintained, 5g of low density polyethylene fibers, having a diameter corresponding to 8 deniers and a length of about 6mm, was dispersed into the said solution, and all the mixture was maintained in contact for 1.5 minute. The fibers thus treated were then separated by filtration, washed several times in water and wrung.

The collected fibers had a very good wettability ($\gamma c > 73$ dynes/cm) and a good aptitude to form non-woven sheets in association with cellulose fibers (very homogeneous dispersion of low density polyethylene fibers in the formed sheet and absence of fluffiness).

EXAMPLE 3

This test was carried out under conditions similar to those used in Example 2, replacing however the low density polyethylene fibers by polypropylene fibers, having an average diameter corresponding to 2.8 deniers and a length of about 6mm, and using a polyvinyl alcohol having a molar hydrolysis weight of 87 to 89 and a viscosity of 19 to 23 centipoises and fixing the quantity of sodium hydroxide at 120mg.

The fibers collected after treatment had quite a good wettability ($\gamma c$ = 58 dynes/cm) as well as a satisfactory aptitude to form films similar to films of non-woven materials (satisfactory dispersion of the modified polypropylene fibers in the formed sheet).

EXAMPLE 4

This test was carried out under conditions similar to those used in test A of example 1, replacing however the low density polyethylene fibrils by a powder of the same low density polyethylene having an average granulation of 250 microns.

The collected modified powder had a good wettability ($\gamma c$ = 72 dynes/cm).

The treatment, according to the invention, applied to a polyolefin powder thus also gives a powder with an improved wettability.

EXAMPLE 5

This test was carried out under conditions similar to those used in test A of example 1, replacing however the low density polyethylene fibers by fibrils of the same low density polyethylene charged with 40% (test 1) or 80% (test II) by weight of chalk (dolomite).

The fibrils obtained after treatment of each of the tests 1 and II have a very good water wettability ($\gamma c > 73$ dynes/cm). Moreover the formed sheets prepared from the treated polyethylene fibrils were very homogeneous (good dispersion of the modified polyethylene fibrils in the formed sheet) and no fluffiness was observed.

EXAMPLE 6

This test was carried out under conditions similar to those used in test A of example 1, replacing however the sodium hydroxide by 70mg of potassium hydroxide.

The fibrils obtained after treatment had a good wettability ($\gamma c = 71$ dynes/cm) as well as a good aptitude to form sheets similar to paper in association with cellulose fibers (homogeneous dispersion of the polyethylene fibrils in the formed sheets and absence of fluffiness).

As has been illustrated in example 5, the polyolefins, especially in the form of fibers, fibrils or powders, which are submitted to the treatment according to the invention, can contain various additives, and especially charges such as, for example, chalk, talc, $TiO_2$, as long as these additives do not react with the components in the treated aqueous medium (water, polyvinyl alcohol, alkali metal hydroxide) of the polyolefins containing the said additives.

Naturally the invention is not confined to the embodiments described here, many alternative versions are possible, for someone skilled in the art, without departing from the spirit of the invention.

What is claimed is:

1. A process to improve the water wettability of polyolefins, wherein said polyolefins are contacted with a polyvinyl alcohol in an aqueous phase, which comprises contacting the aforesaid materials in the presence of an alkali metal hydroxide in a quantity in weight at least equal to half the quantity of the polyvinyl alcohol which is used.

2. Process according to claim 1 wherein the alkali metal hydroxide is a hydroxide of a metal selected from the group IA of the Periodic Classification.

3. Process according to claim 1 wherein the quantity in weight of alkali metal hydroxide is between 0.5 and 10 times the quantity in weight of polyvinyl alcohol used.

4. Process according to claim 1, wherein the quantity in weight of alkali metal hydroxide is between 0.8 and 5 times the quantity in weight of the polyvinyl alcohol used.

5. Process according to claim 1, wherein the quantity of polyvinyl alcohol which is brought into contact with the polyolefin is between 0.1 and 10% of the weight of the said polyolefin.

6. Process according to claim 1, wherein the quantity of polyvinyl alcohol which is brought into contact with the polyolefin is between 0.3 and 3% of the weight of the said polyolefin.

7. Process according to claim 1, wherein the polyvinyl alcohol used has a viscosity, measured at 20° C. in a 4% aqueous solution, from 1 to 70 centipoises.

8. Process according to claim 7, wherein the polyvinyl alcohol has a rate of hydrolysis varying between 79% and 99.8% and a polymerization index of from 350 to 2500.

9. Process according to claim 1, wherein in the aqueous phase, containing a polyolefin, polyvinyl alcohol and alkali metal hydroxide, the weight of the polyolefin is between 0.5 and 50% by weight of water.

10. Process according to claim 9, wherein, the weight of the polyolefin is between 1 and 20% by weight of water.

11. Process according to claim 1, wherein the temperature, when putting the polyolefin into contact with the polyvinyl alcohol in the presence of an alkali metal hydroxide, is comprised between 5 and 90° C.

12. Process according to claim 11, wherein the temperature is between 10 and 55° C.

13. Process according to claim 1 wherein the treated polyolefins are (1) copolymers or homopolymers of $C_2$ to $C_8$ olefins, or (2) copolymers of $C_2$ to $C_8$ olefins, with a minor molar quantity of a vinyl monomer.

14. Process according to claim 13, wherein the treated polyolefins are (1) copolymers or homopolymers of $C_2$ to $C_6$ olefins, or (2) copolymers of $C_2$ to $C_6$ olefins.

15. Process of manufacturing sheets or films, partially or totally synthetic, in which a fibrous film is formed from an aqueous suspension of fibers or fibrils, then the said fibrous film is dried, wherein at least a part of the said fibers or fibrils consists in improved water wettability polyolefin fibers or fibrils obtained by the process according to claim 1.

16. A process according to claim 1 wherein the contacting of the polyolefin with the polyvinyl alcohol is effected in a batchwise or a continuous operation.

17. A process according to claim 2 wherein the alkali metal hydroxide is sodium hydroxide or potassium hydroxide.

18. A process according to claim 13 wherein the vinyl monomer is vinyl acetate or styrene.

19. A process according to claim 13 wherein the alkyl methacrylate is methyl or ethyl methacrylate.

20. A process according to claim 13 wherein the alkyl acrylate is methyl or ethyl acrylate.

21. A process according to claim 1 wherein the polyolefin is a substance selected from the group consisting of a polyethylene, a polypropylene, polybutenes, polypentenes, propylene/ethylene copolymers, butene-/ethylene copolymers, poly(4-methyl pentene-1), vinyl acetate/ethylene copolymers, maleic anydride/ethylene copolymers, and ethylene/ethyl or methyl methacrylate and acrylate copolymers.

22. A process according to claim 21 wherein the polymer is polyethylene or polypropylene.

23. A process according to claim 1 wherein the polyolefin is in the form of a fiber, fibril or powder.

24. The process of claim 13 wherein the vinyl monomer is selected from the group consisting of vinyl acetate, styrene, maleic anhydride, an alkyl acrylate and an alkyl methacrylate.

25. The process of claim 1 wherein the polyolefin contains a filler.

26. The process of claim 25 wherein the filler is a material selected from the group consisting of chalk, talc and $TiO_2$.

* * * * *